US009030385B2

(12) United States Patent
Kikuta

(10) Patent No.: US 9,030,385 B2
(45) Date of Patent: May 12, 2015

(54) IMAGE PROCESSING APPARATUS, DISPLAY SYSTEM, ELECTRONIC APPARATUS, AND METHOD OF PROCESSING IMAGE

(75) Inventor: Kazuto Kikuta, Hachioji (JP)

(73) Assignee: Seiko Epson Corporation, Tokyo (JP)

( * ) Notice: Subject to any disclaimer, the term of this patent is extended or adjusted under 35 U.S.C. 154(b) by 849 days.

(21) Appl. No.: 12/835,070

(22) Filed: Jul. 13, 2010

(65) Prior Publication Data

US 2011/0050744 A1 Mar. 3, 2011

(30) Foreign Application Priority Data

Aug. 26, 2009 (JP) ..... 2009-195123

(51) Int. Cl.
*G09G 3/30* (2006.01)
*G09G 3/32* (2006.01)

(52) U.S. Cl.
CPC ..... *G09G 3/3233* (2013.01); *G09G 2320/0285* (2013.01); *G09G 2320/029* (2013.01); *G09G 2320/043* (2013.01)

(58) Field of Classification Search
CPC ..... G09G 2320/043; G09G 2320/029; G09G 3/3233; G09G 2320/0285; G09G 2320/0295; G09G 2320/0233; G09G 2320/045; G09G 2320/041; G09G 2320/0693
USPC ..... 315/169.1–169.3; 345/204–214, 690, 345/691, 76–89
See application file for complete search history.

(56) References Cited

U.S. PATENT DOCUMENTS

| | | | | |
|---|---|---|---|---|
| 6,292,591 | B1 | 9/2001 | Kondo | |
| 7,088,052 | B2 | 8/2006 | Kimura | |
| 7,227,519 | B1 | 6/2007 | Kawase et al. | |
| 7,414,795 | B2 | 8/2008 | Cok | |
| 7,859,492 | B2 * | 12/2010 | Kohno | 345/77 |
| 2001/0024186 | A1 | 9/2001 | Kane et al. | |
| 2002/0030647 | A1 | 3/2002 | Hack et al. | |
| 2002/0033783 | A1 * | 3/2002 | Koyama | 345/82 |
| 2003/0011314 | A1 | 1/2003 | Numao | |
| 2003/0058229 | A1 | 3/2003 | Kawabe et al. | |
| 2003/0063053 | A1 * | 4/2003 | Yamazaki et al. | 345/82 |

(Continued)

FOREIGN PATENT DOCUMENTS

| | | |
|---|---|---|
| JP | A-2001-142437 | 5/2001 |
| JP | A-2001-350442 | 12/2001 |

(Continued)

OTHER PUBLICATIONS

U.S. Appl. No. 13/084,186, filed Apr. 11, 2011 in the name of Kazuto Kikuta.

(Continued)

*Primary Examiner* — Gregory J Tryder
(74) *Attorney, Agent, or Firm* — Oliff PLC

(57) ABSTRACT

An image processing apparatus which corrects pixel data corresponding to pixels configuring a display image of a display device having light emitting elements includes an information storage unit which, in units of one or a plurality of pixels of the display device, stores information corresponding to operating currents of light emitting elements included in the one or plurality of pixels, and a pixel data correction unit which corrects the pixel data based on the information corresponding to the operating currents stored in the information storage unit.

2 Claims, 9 Drawing Sheets

(56) References Cited

U.S. PATENT DOCUMENTS

| | | | | |
|---|---|---|---|---|
| 2003/0090446 | A1 | 5/2003 | Tagawa et al. | |
| 2003/0122813 | A1* | 7/2003 | Ishizuki et al. | 345/211 |
| 2004/0150592 | A1* | 8/2004 | Mizukoshi et al. | 345/76 |
| 2004/0222954 | A1 | 11/2004 | Lueder | |
| 2005/0110420 | A1* | 5/2005 | Arnold et al. | 315/169.3 |
| 2005/0110720 | A1* | 5/2005 | Akimoto et al. | 345/76 |
| 2005/0110728 | A1* | 5/2005 | Cok | 345/82 |
| 2005/0156831 | A1 | 7/2005 | Yamazaki et al. | |
| 2005/0195178 | A1 | 9/2005 | Jo et al. | |
| 2005/0253785 | A1 | 11/2005 | Miyasaka et al. | |
| 2006/0001613 | A1 | 1/2006 | Routley et al. | |
| 2007/0080905 | A1 | 4/2007 | Takahara | |
| 2007/0091042 | A1 | 4/2007 | Chung et al. | |
| 2007/0127569 | A1 | 6/2007 | Hatalkar | |
| 2007/0290947 | A1 | 12/2007 | Cok | |
| 2008/0024526 | A1 | 1/2008 | Ko et al. | |
| 2008/0036703 | A1 | 2/2008 | Wang et al. | |
| 2008/0048951 | A1 | 2/2008 | Naugler et al. | |
| 2008/0111812 | A1 | 5/2008 | Shirasaki et al. | |
| 2008/0111886 | A1 | 5/2008 | Bai | |
| 2008/0143729 | A1 | 6/2008 | Wyatt et al. | |
| 2008/0204378 | A1 | 8/2008 | Park et al. | |
| 2008/0284702 | A1 | 11/2008 | Shidara et al. | |
| 2009/0040151 | A1 | 2/2009 | Lee | |
| 2009/0051637 | A1 | 2/2009 | Chen et al. | |
| 2010/0123649 | A1* | 5/2010 | Hamer et al. | 345/76 |
| 2011/0043551 | A1 | 2/2011 | Kikuta | |
| 2011/0050744 | A1 | 3/2011 | Kikuta | |

FOREIGN PATENT DOCUMENTS

| | | | |
|---|---|---|---|
| JP | A-2003-280578 | | 10/2003 |
| JP | A-2004-184900 | | 7/2004 |
| JP | A-2005-055800 | | 3/2005 |
| JP | A-2005-062485 | | 3/2005 |
| JP | A-2005-530203 | | 10/2005 |
| JP | A-2007-65015 | | 3/2007 |
| JP | A-2007-304318 | | 11/2007 |
| JP | A-2007-322460 | | 12/2007 |
| JP | A-2007-333997 | | 12/2007 |
| JP | A-2008-197626 | | 8/2008 |
| JP | A-2009-086673 | | 4/2009 |
| JP | A-2011-28149 | | 2/2011 |
| JP | A-2011-39042 | | 2/2011 |
| JP | A-2011-48043 | | 3/2011 |
| WO | WO 03/107318 | A1 | 12/2003 |

OTHER PUBLICATIONS

U.S. Appl. No. 13/084,083, filed Apr. 11, 2011 in the name of Kazuto Kikuta.
May 2, 2014 Office Action issued in U.S. Appl. No. 13/084,083.
Sep. 5, 2013 Notice of Allowance issued in U.S. Appl. No. 12/835,824.
Oct. 3, 2013 Office Action issued in U.S. Appl. No. 13/084,186.
U.S. Appl. No. 12/835,824, filed Jul. 14, 2010 in the name of Kikuta.
Feb. 22, 2013 Office Action issued in U.S. Appl. No. 12/835,824.
Nov. 2, 2012 Office Action issued in U.S. Appl. No. 12/835,824.
Apr. 15, 2013 Office Action issued in U.S. Appl. No. 13/084,186.
Dec. 26, 2013 Office Action issued in U.S. Appl. No. 13/084,083.
Jul. 23, 2013 Office Action issued in U.S. Appl. No. 13/084,083.
Oct. 10, 2014 Office Action issued in U.S. Appl. No. 13/084,083.

* cited by examiner

| INPUT VALUE | OUTPUT VALUE |
|---|---|
| $Q_1$ | $V_1$ |
| $Q_2$ | $V_2$ |
| ⋮ | ⋮ |

IMAGE PROCESSING APPARATUS, DISPLAY SYSTEM, ELECTRONIC APPARATUS, AND METHOD OF PROCESSING IMAGE

This application claims priority based on Japanese Patent Application No. 2009-195123, filed on Aug. 26, 2009, which is incorporated in this specification.

BACKGROUND

1. Technical Field

An aspect of the present invention relates to an image processing apparatus, a display system, an electronic apparatus, an image processing method.

2. Background Art

In recent years, an LCD (liquid crystal display) panel using liquid crystal elements as display elements, and a display panel (a display device) using organic light emitting diodes (hereafter abbreviated as OLED's) (in the broad sense, light emitting elements) as display elements, have been in widespread use. In particular, OLED's having a high response speed, it is possible to improve a contrast ratio. For this reason, according to a display panel having OLED's disposed in a matrix form, it is possible to display a high quality image with a wide viewing angle.

However, in the display panel using the OLED's, as a differing organic material is used for each color component configuring one pixel, a difference occurs in the degree of degradation in luminance after use, causing a deterioration in image quality. Also, with the display panel using the OLED's, a luminance and color unevenness attributed to manufacture reduces a product yield, which also becomes a factor in preventing a reduction in cost. Consequently, in the event that it is possible to reduce the luminance and color unevenness, as well as it being possible to prevent a deterioration in image quality after use, it is possible to contribute to a reduction in cost.

A technology of correcting this kind of luminance and color unevenness of the OLED's is disclosed in, for example, JP-T-2005-530203 and JP-A-2007-65015. In JP-T-2005-530203, a driver circuit is disclosed which, by controlling a power supply voltage to a constant current source which drives display elements, carries out a control corresponding to external factors such as a temperature, a life span of a display panel, and a current drive change. Also, in JP-A-2007-65015, a main control circuit is disclosed which analyses input pixel data of each color component, generates a gradation histogram for each frame, obtains a luminance sum based on these, and corrects the pixel data using the sum.

SUMMARY

However, the luminance and color unevenness are caused by a variation in light emitting elements themselves and a variation in a drive current which drives the light emitting elements. For this reason, with the technologies disclosed in Patent Document 1 and Patent Document 2, it is not possible to simultaneously correct the variation in the light emitting elements and the variation in the drive current which drives the light emitting elements, and it is not possible to reduce the luminance and color unevenness of the display panel using the OLED's with a high precision.

The invention has been contrived bearing in mind the above kinds of technical problems. According to some aspects of the invention, it is possible to provide an image processing apparatus, a display system, an electronic apparatus, an image processing method, and the like, which simultaneously correct a variation in light emitting elements and a variation in a drive current which drives the light emitting elements, thus reducing a luminance and color unevenness with a high precision.

MEANS FOR SOLVING THE PROBLEMS (1) According to one aspect of the invention, an image processing apparatus which corrects pixel data corresponding to pixels configuring a display image of a display device having light emitting elements includes an information storage unit which, in units of one or a plurality of pixels of the display device, stores information corresponding to operating currents of light emitting elements included in the one or plurality of pixels; and a pixel data correction unit which corrects the pixel data based on the information corresponding to the operating currents stored in the information storage unit.

According to this aspect, as an arrangement is such as to store the information corresponding to the operating currents of the light emitting elements in units of the one or plurality of pixels of the display device, and correct the pixel data based on the information, it is possible to simultaneously correct a variation in the light emitting elements and a variation in the drive current which drives the light emitting elements, and reduce a luminance and color unevenness with a high precision.

(2) An image processing apparatus according to another aspect of the invention includes a correction information generating unit which generates correction information corresponding to the operating currents of the light emitting elements included in the one or plurality of pixels, wherein the information storage unit stores the correction information.

According to this aspect, in addition to the heretofore described advantage, as an arrangement is such as to generate the correction information corresponding to the operating currents of the light emitting elements included in the one and plurality of pixels, and store the correction information in the information storage unit, it is possible to generate optimum correction information corresponding to a color component and the type of the display device for the same operating current values, thus enabling a high precision correction of the luminance and color unevenness.

(3) With an image processing apparatus according to another aspect of the invention, the correction information generating unit generates the correction information based on difference information having a minimum operating current, of the operating currents of the light emitting elements included in the one or plurality of pixels, in one screen as a reference.

According to this aspect, in addition to the heretofore described advantage, as an arrangement is such as to generate the difference information corresponding to each operating current with the minimum operating current as a reference, and generate the correction information based on the difference information, it is possible to reduce the information amount of the correction information.

(4) An image processing apparatus according to another aspect of the invention includes a condition setting register in which control data corresponding to a pixel data correction range are set; and a pixel data analysis unit which, based on the control data set in the condition setting register, carries out a process of determining whether or not to correct the pixel data, wherein the pixel data correction unit is such that an enable control of a process of correcting the pixel data is carried out based on a result of the processing of the pixel data analysis unit.

According to this aspect, in addition to the heretofore described advantage, it is possible to realize, for example, a color filtering process wherein a pixel data correction is carried out on a gradation portion of skin color or the like in an image because color unevenness becomes conspicuous in the gradation portion, while brightness is secured, without correcting the pixel data, for an image with many white portions such as clouds.

(5) An image processing apparatus according to another aspect of the invention includes an adjustment data storage unit in which adjustment data for adjusting the pixel data are stored, wherein the pixel data correction unit corrects the pixel data using the adjustment data stored in the adjustment data storage unit.

According to this aspect, in addition to the advantage of the pixel data correction process based on the correction information, it is possible to provide an image processing apparatus capable of a desired fine adjustment of the luminance and color unevenness.

(6) An image processing apparatus according to another aspect of the invention includes an operating current value import unit which, in synchronization with a pixel clock corresponding to the pixel data, sequentially imports information corresponding to the operating currents of the one or plurality of light emitting elements, wherein the operating current value import unit imports the information corresponding to the operating currents based on a current flowing through a resistance circuit inserted in a power wire which supplies a power supply voltage to the display device.

According to this aspect, in addition to the heretofore described advantage, it is possible to provide an image processing apparatus with which it is possible to eliminate a need for an excess external circuit for importing the operating currents, and contribute to a simplification of the configuration of a display system.

(7) According to another aspect of the invention, a display system includes a display panel having a plurality of row signal lines, a plurality of column signal lines provided intersecting the plurality of row signal lines, and a plurality of light emitting elements which, being specified by any of the plurality of row signal lines and any of the plurality of column signal lines, emit light with a luminance corresponding to a drive current; a row driver which drives the plurality of row signal lines; a column driver which drives the plurality of column signal lines; and the image processing apparatus according to any one of the heretofore described aspects which, as well as outputting a display timing control signal to the row driver and column driver, outputs the pixel data to the column driver.

According to this aspect, it is possible to provide a display system which simultaneously corrects the variation in the light emitting elements and the variation in the drive current which drives the light emitting elements, thus reducing the luminance and color unevenness with a high precision.

(8) According to another aspect of the invention, a display system includes a display panel having a plurality of row signal lines, a plurality of column signal lines provided intersecting the plurality of row signal lines, and a plurality of light emitting elements which, being specified by one of the plurality of row signal lines and one of the plurality of column signal lines, emit light with a luminance corresponding to a drive current; a row driver which drives the plurality of row signal lines; a column driver which drives the plurality of column signal lines; the heretofore described image processing apparatus which, as well as outputting a display timing control signal to the row driver and column driver, outputs the pixel data to the column driver; and a power supply unit which supplies power to the display panel, row driver, column driver, and image processing apparatus, wherein the image processing apparatus imports an operating current corresponding to a current flowing through a resister inserted in a power wire which supplies a power supply voltage to the display panel.

According to this aspect, it is possible to provide a display system which simultaneously corrects the variation in the light emitting elements and the variation in the drive current which drives the light emitting elements, thus reducing the luminance and color unevenness with a high precision, and of which the configuration is simplified by eliminating a need for an excess external circuit for importing the operating currents.

(9) According to another aspect of the invention, an electronic apparatus includes the image processing apparatus according to any one of the heretofore described aspects.

According to this aspect, it is possible to provide an electronic apparatus to which is applied the image processing apparatus which simultaneously corrects the variation in the light emitting elements and the variation in the drive current which drives the light emitting elements, thus reducing the luminance and color unevenness with a high precision.

(10) According to another aspect of the invention, an image processing method which corrects pixel data corresponding to pixels configuring a display image of a display device having light emitting elements includes an information storage step which, in units of one or a plurality of pixels of the display device, stores information corresponding to operating currents of light emitting elements included in the one or plurality of pixels; and a pixel data correction step which corrects the pixel data based on the information corresponding to the operating currents stored in the information storage step.

According to this aspect, as an arrangement is such that the information corresponding to the operating currents of the light emitting elements is stored in units of the one or plurality of pixels of the display device, and the pixel data are corrected based on the information, it is possible, by simultaneously correcting the variations in the light emitting elements and in the drive current which drives the light emitting elements, to reduce the luminance and color unevenness with a high precision.

(11) An image processing method according to another aspect of the invention includes a correction information generating step which generates correction information corresponding to the operating currents of the light emitting elements included in the one or plurality of pixels, wherein the correction information generating step generates the correction information based on difference information having a minimum operating current, of the operating currents of the light emitting elements included in the one or plurality of pixels, in one screen as a reference, and the information storage step stores the correction information.

According to this aspect, in addition to the heretofore described advantage, as an arrangement is such that the difference information is generated corresponding to each operating current with the minimum operating current as a reference, and the correction information is generated based on the difference information, it is possible to reduce the information amount of the correction information.

(12) An image processing method according to another aspect of the invention includes a condition setting step in which control data corresponding to a pixel date correction range are set; and a pixel data analysis step which, based on the control data set in the condition setting step, carries out a process of determining whether or not to correct the pixel data, wherein the pixel data correction step, based on a result of the processing in the pixel data analysis step, carries out an enable control of a process of correcting the pixel data.

According to this aspect, in addition to the heretofore described advantage, it is possible to realize, for example, the color filtering process wherein the pixel data correction is carried out on a gradation portion of skin color or the like in an image because color unevenness becomes conspicuous in the gradation portion, while brightness is secured, without correcting the pixel data, for an image with many white portions such as clouds.

DESCRIPTION OF EXEMPLARY EMBODIMENTS

Hereafter, a detailed description will be given, using the drawings, of an embodiment of the invention. The embodiment, to be described hereafter, does not unduly limit the details of the invention described in the claims. Also, not all of configurations to be described hereafter are constituent features essential for solving the problems of the invention.

Figure 1:
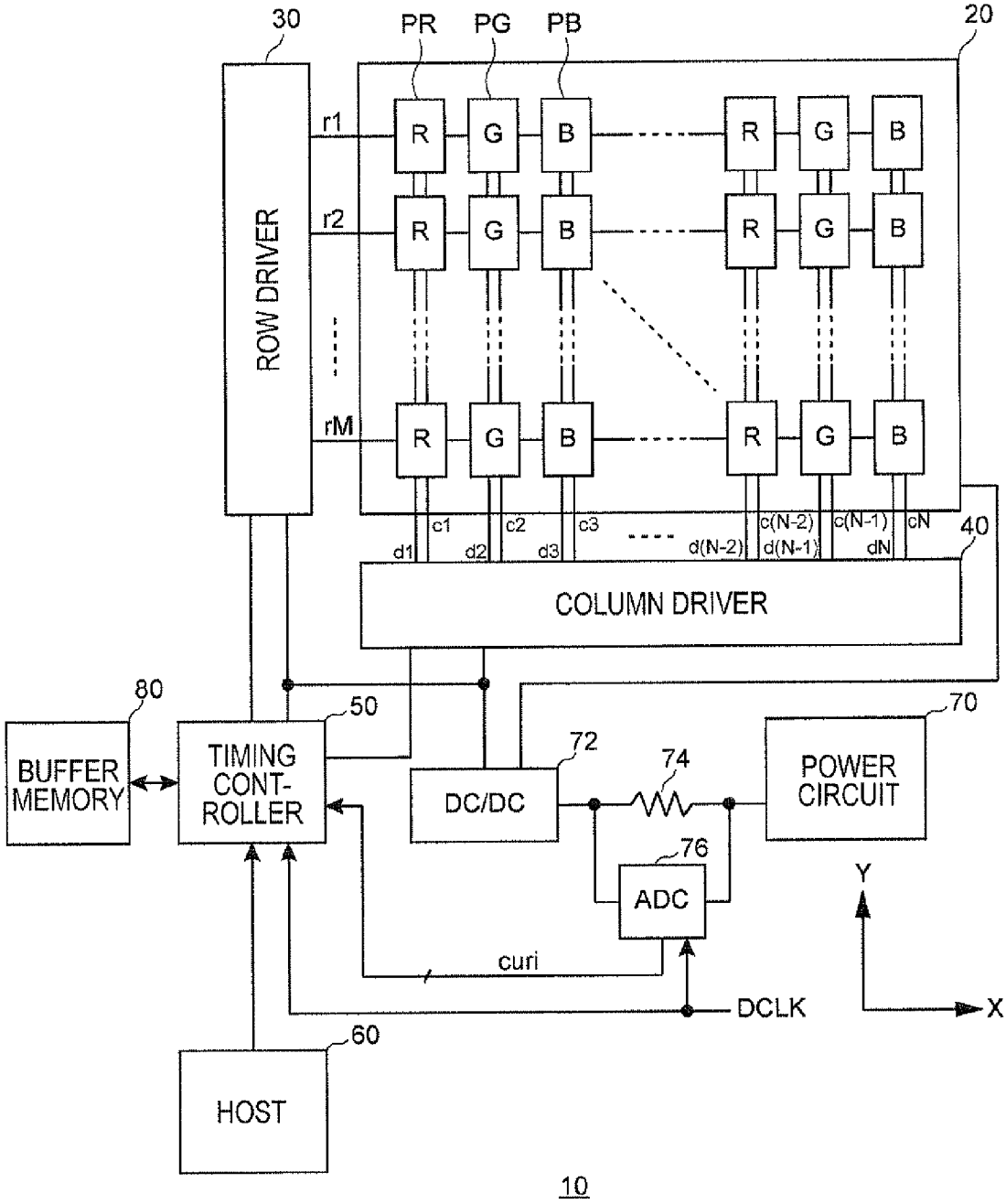
FIG. 1 A block diagram of a configuration example of a display system according to an embodiment of the invention.

FIG. 1 shows a block diagram of a configuration example of a display system according to the embodiment of the invention. The display system has a display panel (a light emitting panel) using OLED's which are light emitting elements acting as display elements, and each OLED is driven by a row driver and a column driver based on a display timing control signal generated by a timing controller.

More specifically, the display system 10 includes a display panel 20, a row driver 30, a column driver 40, a timing controller 50 (in the broad sense, an image processing circuit or an image processing apparatus), a host 60, and a power circuit 70 (a power supply unit). In the display panel 20, as well as a plurality of data signal lines d1 to dN (N is an integer of two or more) and a plurality of column signal lines c1 to cN, extending in a Y direction, being disposed in an X direction, a plurality of row signal lines r1 to rM (M is an integer of two or more) extending in the X direction so as to intersect each column signal line and each data signal line are disposed in the Y direction. A pixel circuit is formed at the intersection of each column signal line (more specifically, each column signal line and each data signal line) and each row signal line, and a plurality of the pixel circuits are disposed in a matrix form in the display panel 20.

In FIG. 1, one dot is configured by an R component pixel circuit PR, a G component pixel circuit PG, and a B component pixel circuit PB which are adjacent in the X direction. The R component pixel circuit PR has an OLED emitting a red display color, the G component pixel circuit PG has an OLED emitting a green display color, and the B component pixel circuit PB has an OLDE emitting a blue display color.

The row driver 30 is connected to the row signal lines r1 to rM of the display panel 20. The row driver 30 sequentially selects the row signal lines r1 to rM of the display panel 20 within, for example, one vertical scanning period, and outputs a selection pulse in each row signal line selection period.

The column driver 40 is connected to the data signal lines d1 to dN and column signal lines c1 to cN of the display panel 20. The column driver 40, as well as applying a given power supply voltage to the column signal lines c1 to cN, applies gradation voltages corresponding to one line's worth of pixel data (image data) one to each data signal line in, for example, each horizontal scanning period. Because of this, in the horizontal scanning period in which a jth ($1 \leq j \leq M$, and j is an integer) row is selected, the gradation voltage corresponding to the pixel data is applied to the pixel circuit on the jth row and in a kth ($1 \leq k \leq N$, and k is an integer) column.

Figure 2:
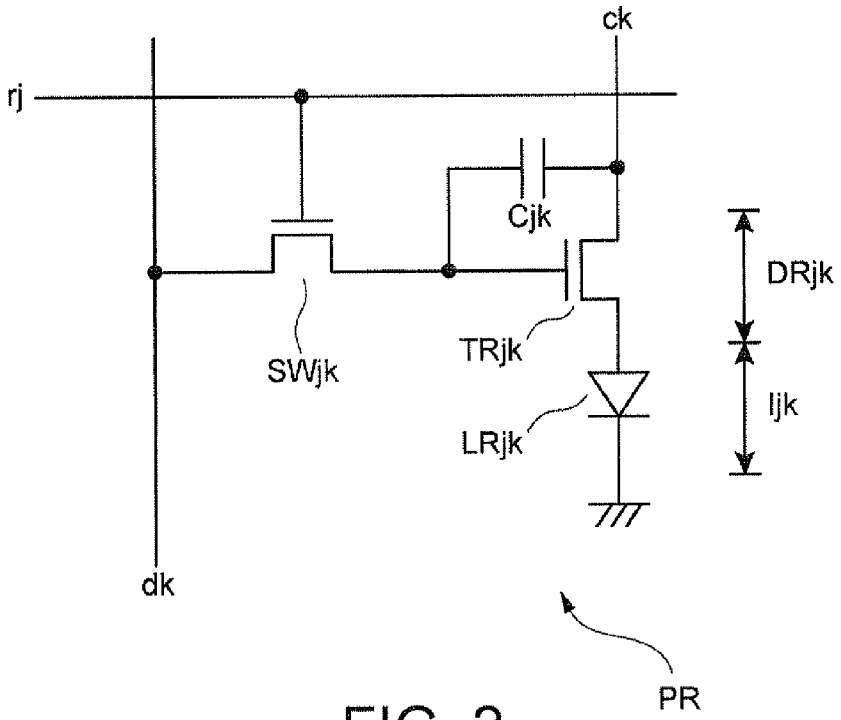
FIG. 2 A circuit diagram of a configuration example of a pixel circuit according to the embodiment.

FIG. 2 shows a circuit diagram of a configuration example of the pixel circuit PR according to the embodiment, FIG. 2 shows a configuration example of an electrical equivalent circuit of the pixel circuit PR, but the pixel circuit PG and pixel circuit PB which configure one pixel together with the pixel circuit PR also have the same configuration as that of FIG. 2. Also, the pixel circuits which configure the other pixels of the display panel 20 of FIG. 1 also have the same configuration as that of FIG. 2.

The pixel circuit PR of FIG. 2 is formed at the intersection of the row signal line rj and column signal line ck. The pixel circuit PR includes a drive transistor TRjk, a switch transistor SWjk, a capacitor Cjk, and a light emitting element LRjk which emits the red display color. The row signal line rj is connected to the gate of the switch transistor SWjk, the data signal line dk is connected to the source of the switch transistor SWjk, and the gate of the drive transistor TRjk is connected to the drain of the switch transistor SWjk. The source of the drive transistor TRjk is connected to the anode of the light emitting element LRjk, and the drain of the drive transistor TRjk is connected to the column signal line ck. The cathode of the light emitting element LRjk is grounded. Also, one end of the capacitor Cjk is connected to the gate of the drive transistor TRjk, and the other end of the capacitor Cjk is connected to the drain of the drive transistor TRjk.

With this kind of configuration, on the selection pulse being applied to the row signal line rj, the switch transistor SW k attains a conductive condition, and the voltage corresponding to the pixel data applied to the data signal line dk is applied to the gate of the drive transistor TRjk. In the event that the given power supply voltage is being applied to the column signal line ck at this time, the drive transistor TRjk attains a conductive condition, and a drive current flows through the light emitting element LRjk. At this time, the red display color is emitted from the light emitting element LRjk.

Figure 3:
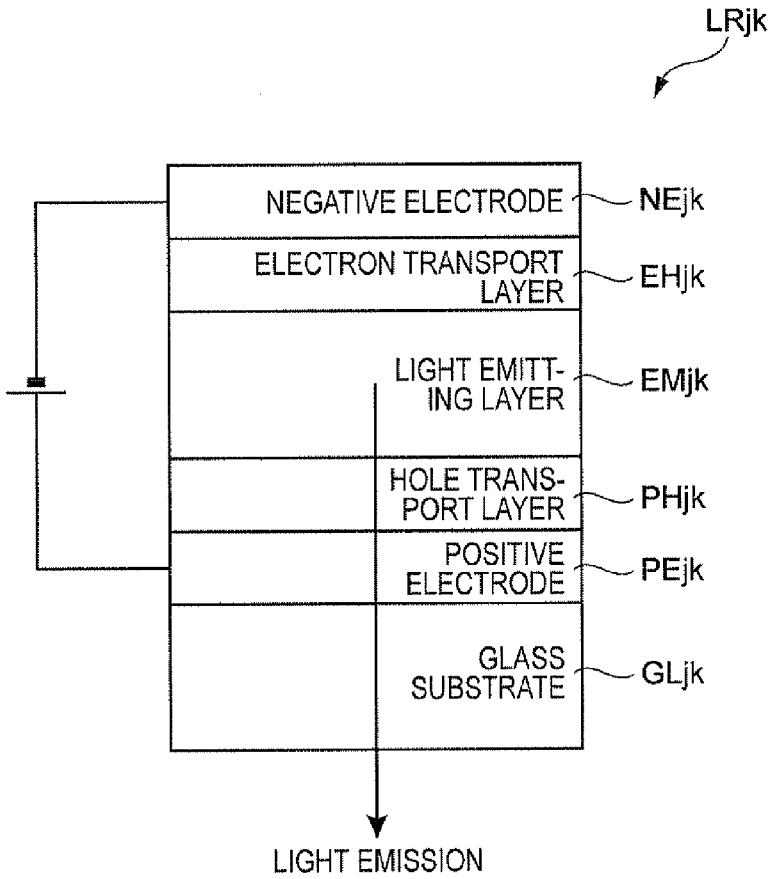
FIG. 3 A diagram schematically showing a principled configuration example of a light emitting element of FIG. 2.

FIG. 3 schematically shows a principled configuration example of the light emitting element LRjk of FIG. 2.

The light emitting element LRjk has formed on a glass substrate GLjk thereof a transparent electrode (for example, an ITO (indium thin oxide)) which is a positive electrode PEjk. A negative electrode NEjk is formed above the positive electrode PEjk. Then, organic layers including a light emitting layer, and the like, are formed between the positive electrode PEjk and negative electrode NEjk. The organic layers have a hole transport layer PHjk formed on the top of the positive electrode PEjk, the light emitting layer EMjk formed on the top of the hole transport layer PHjk, and an electron transport layer EHjk formed between the light emitting layer EMjk and negative electrode NEjk.

For example, when the selection pulse is applied to the row signal line rj, causing the drive transistor TRjk to generate a drain current in accordance with the voltage applied to the data signal line dk, a potential difference between the positive electrode PEjk and negative electrode NEjk of FIG. 3 is provided. When the potential difference between the positive electrode PEjk and negative electrode NEjk is provided, a hole from the positive electrode PEjk and an electron from the negative electrode NEjk are recombined in the light emitting layer EMjk. Molecules of the light emitting layer EMjk attain an excited state due to energy generated at this time, and energy released when they return to a ground state changes to light. The light passes through the positive electrode PEjk formed of a transparent electrode, and the glass substrate GLjk.

In FIG. 1, the timing controller 50, as well as supplying the display timing control signal to the row driver 30 and column driver 40, supplies pixel data corresponding to a display image to the column driver 40. Because of this, the row driver 30 and column driver 40 can supply operating currents corresponding to the pixel data to the light emitting elements of pixels configuring scanning lines sequentially selected within one vertical scanning period. The timing controller 50 according to the embodiment holds a current value (an operating current value) for driving each pixel of the display panel 20 and, by supplying the pixel data corrected based on the current values to the column driver 40, corrects a luminance and color unevenness (that is, a luminance unevenness and a color unevenness, the same applies below) of the OLED's. That is, the luminance and color unevenness of the light emitting elements are corrected in units of one or a plurality of pixels of the display panel 20 by an information storage step which stores information corresponding to the operating currents of the light emitting elements included in the one or plurality of pixels, and by a pixel data correction step which corrects the pixel data based on the information corresponding to the operating currents stored in the information storage step.

For this reason, a buffer memory 80 being connected to the timing controller 50, as a correction information generating step, correction information is generated while the operating current value (the information corresponding to the operating current) of each pixel is being stored in the buffer memory 80, and the pixel data are corrected based on the correction information. At least one frame's worth of pixel data, apart from the operating current values, may be buffered in the buffer memory 80. Alternatively, instead of providing the buffer memory 80, a memory having a function the same as the buffer memory 80 may be built into the timing controller 50.

The host 60, as well as generating the image data corresponding to the display image, sets control data in various kinds of control register in the timing controller 50, and carries out a display control of the display panel 20 by the row driver 30 and column driver 40.

The power circuit 70 generates a plurality of kinds of power supply voltage, and supplies the power supply voltages to the display panel 20, the row driver 30, the column driver 40, and each unit of the timing controller 50. In the embodiment, the operating current value of each pixel, including the OLED, is measured on a power wire from the power circuit 70, and the luminance and color unevenness of the OLED's are corrected by correcting the pixel data based on the operating current values.

For example, in the pixel circuit PR shown in FIG. 2, the luminance and color unevenness are caused by a variation in the light emitting element LRjk and a variation in the drive current of the light emitting element LRjk. Herein, the variation in the light emitting element LRjk corresponds to a variation in a current Ijk flowing through the light emitting element LRjk, and the variation in the drive current of the light emitting element LRjk corresponds to a variation in a drain current DRjk of the drive transistor TRjk. As the operating current of each pixel depends on, for example, not only the characteristic of the OLED itself, but the characteristic of the drive transistor for driving the OLED or of a drive circuit which drives the data signal line, it is possible, by correcting the pixel data based on the heretofore described kind of current value corresponding to the operating current of each pixel, to simultaneously correct variations in the OLED and in the drive current which drives the OLED, and reduce the luminance and color unevenness with a high precision.

Therein, the display system 10 includes a DC/DC converter 72, a resistance circuit 74, and an A/D converter (ADC) 76. The DC/DC converter 72 converts the level of a direct current power supply voltage generated by the power circuit 70, and supplies the converted direct current power supply voltage to the display panel 20, row driver 30, column driver 40, timing controller 50, and the like. The resistance circuit 74 is inserted into the power wire connecting the power circuit 70 and DC/DC converter 72. The A/D converter 76, being connected in parallel with the resistance circuit 74, converts an analog value of current flowing through the resistance circuit 74 into a digital current value curi in synchronization with a pixel clock DCLK, and outputs it to the timing controller 50.

By means of this kind of configuration, it is possible, every time the light emitting elements are lighted in units of one pixel in synchronization with the pixel clock DCLK, to import a current value of the resistance circuit 74 inserted in the power wire connected to the power circuit 70. The current value corresponds to the heretofore described operating current value of the light emitting element configuring one pixel.

Figure 4:
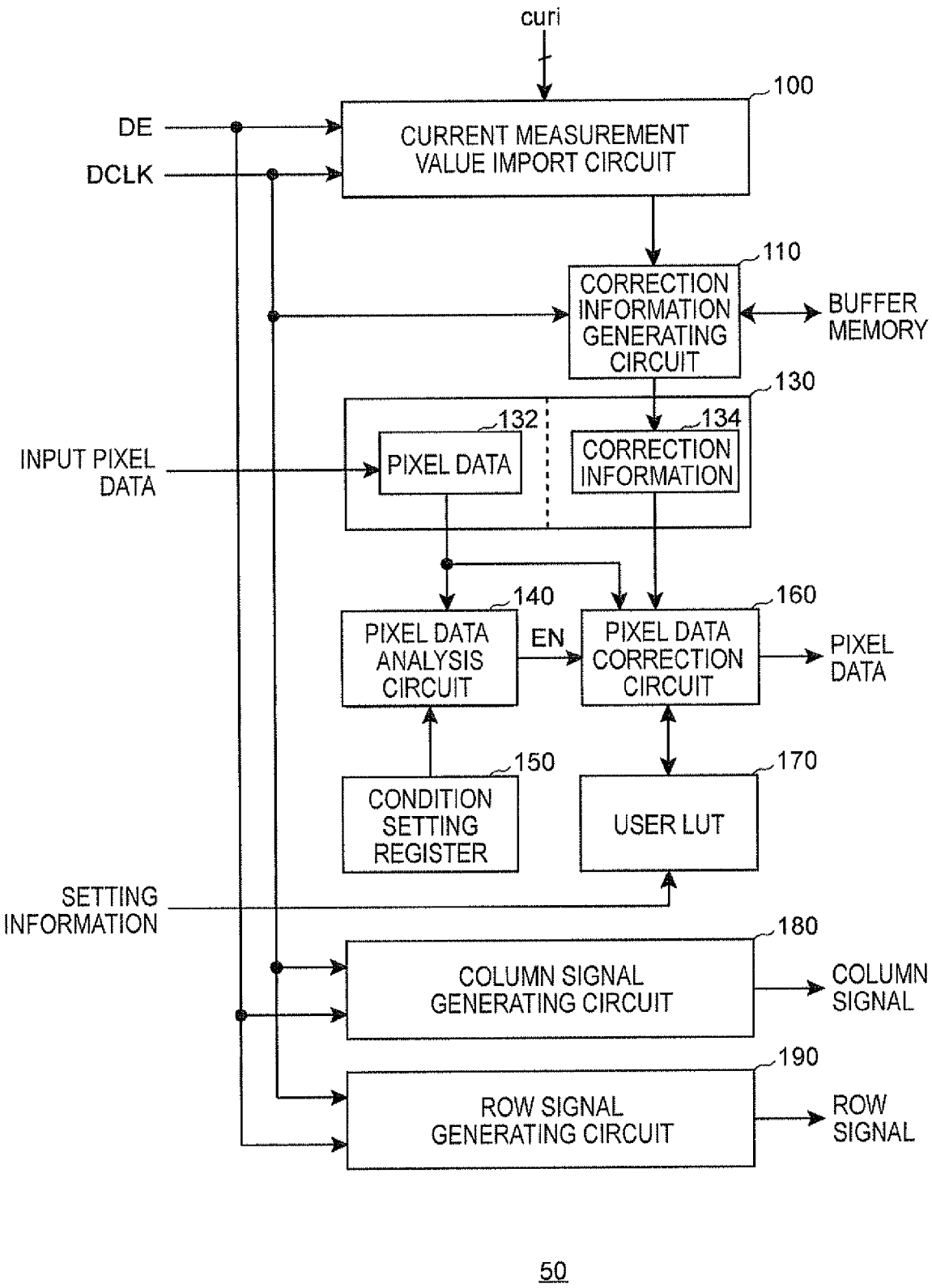
FIG. 4 A block diagram of a configuration example of a timing controller of FIG. 1.

FIG. 4 shows a block diagram of a configuration example of the timing controller 50 of FIG. 1.

The timing controller 50 includes a current measurement value import circuit 100 (an operating current value import unit), a correction information generating circuit 110 (a correction information generating unit), a data storage unit 130, a pixel data analysis circuit 140 (a pixel data analysis unit), a condition setting register 150, a pixel data correction circuit 160, a user LUT 170 (an adjustment data storage unit), a column signal generating circuit 180, and a row signal generating circuit 190. The data storage unit 130 includes a pixel data storage unit 132 and a correction information storage unit 134.

A data enable signal DE generated by the host 60 or an unshown display timing generating circuit, and the pixel clock DCLK, are input into each of these kinds of unit configuring the timing controller 50. The pixel data from the host 60 are input in synchronization with the pixel clock DCLK, and the data enable signal DE is a signal indicating that the pixel data from the host 60 are valid.

The current measurement value import circuit 100, in synchronization with the pixel clock DCLK corresponding to the pixel data of an image to be displayed, sequentially imports the operating current value (or the information corresponding to the operating current) of one light emitting element included in one pixel of the display panel 20. At this time, the current measurement value import circuit 100 imports, as the operating current value, the value of the current flowing through the resistance circuit inserted in the power wire from the power circuit 70 which supplies the power supply voltage to the display panel 20. The current measurement value import circuit 100 may be arranged so as to import the current values of a plurality of the light emitting elements in synchronization with the pixel clock DCLK.

The correction information generating circuit 110 generates the correction information based on the operating current values imported by the current measurement value import circuit 100. Because of this, optimum correction information in accordance with the color component and the type of the display panel 20 can be generated for the same operating current values, thus enabling a high precision correction of the luminance and color unevenness. More specifically, the correction information generating circuit 110 generates the correction information based on difference information having a minimum operating current value (information corresponding to a minimum operating current), among the respectively imported operating current values, in one screen as a reference. The correction information generated by the correction information generating circuit 110 is stored in the correction information storage unit 134 (an information storage unit) of the data storage unit 130. By generating the correction information based on the difference information in this way, it is possible to reduce an information amount, and it is possible to reduce a capacity to be secured in the correction information storage unit 134. The correction information stored in the correction information storage unit 134 is supplied to the pixel data correction circuit 160.

One frame's worth of pixel data corresponding to the image to be displayed are sequentially stored in the pixel data storage unit 132 of the data storage unit 130 from, for example, the host 60, and buffered. An arrangement may be such that the pixel data from the host 60 are stored in the pixel data storage unit 132 after being once buffered in the buffer memory 80. The pixel data stored in the pixel data storage unit 132 are output to the pixel data analysis circuit 140 and pixel data correction circuit 160.

The pixel data analysis circuit 140, based on the control data set in the condition setting register 150, carries out a process of determining whether or not to correct the pixel data for each color component and, based on a result of this processing, carries out an enable control of a correction process of the pixel data correction circuit 160 for each color component. The control data corresponding to a pixel data correction range are set in the condition setting register 150 by, for example, the host 60.

That is, a pixel data correction process, including a condition setting step in which the control data corresponding to the pixel data correction range are set, and a pixel data analysis step which, based on the control data set in the condition setting step, carries out the process of determining whether or not to correct the pixel data, is enable controlled based on a processing result in the pixel data analysis step. As an arrangement is such that the pixel data analysis circuit 140 carries out the enable control of the pixel data correction process in the pixel data correction circuit 160 in this way, a correction specific to the pixel data such as, for example, a color filtering process, is possible.

The pixel data correction circuit 160, based on the correction information stored in the correction information storage unit 134, carries out the correction process on the pixel data stored in the pixel data storage unit 132 for each color component. As the correction information is generated based on the operating current values of the light emitting elements of the display panel 20, the pixel data correction circuit 160 can carry out the pixel data correction in accordance with the operating current value of the light emitting element to be driven.

Furthermore, in the embodiment, the pixel data correction circuit 160 is arranged so as to be able to adjust the pixel data using the user LUT 170 (adjustment data storage unit) which can be set by a user via the host 60. Adjustment data acting as setting information for adjusting the pixel data are stored in advance in the user LUT 170, as adjusted pixel data to be output, correlated to desired pixel data, and, for example, the pixel data correction circuit 160, after adjusting the pixel data by referring to the user LUT 170 prior to the pixel data correction process, carries out the correction process on the adjusted pixel data using the heretofore described correction information. This enables a fine adjustment of luminance and color unevenness which the user desires.

The column signal generating circuit 180 generates a column signal which controls the column driver 40, and outputs the column signal to the column driver 40. The row signal generating circuit 190 generates a row signal which controls the row driver, and outputs the row signal to the row driver 30. The column signal and row signal are supplied to the column driver 40 and row driver 30 from the timing controller 50 as the display timing control signal.

By means of this kind of configuration, as the timing controller 50 is arranged so as to store information corresponding to the operating currents of the light emitting elements in units of one pixel of the display panel, and correct the pixel data based on the information, it is possible to simultaneously correct the variations in the light emitting elements and in the drive current which drives the light emitting elements, and reduce the luminance and color unevenness with a high precision.

Hereafter, a description will be given of a configuration example of each unit of the timing controller 50 according to the embodiment.

<Current Measurement Value Import Circuit>

Figure 5:
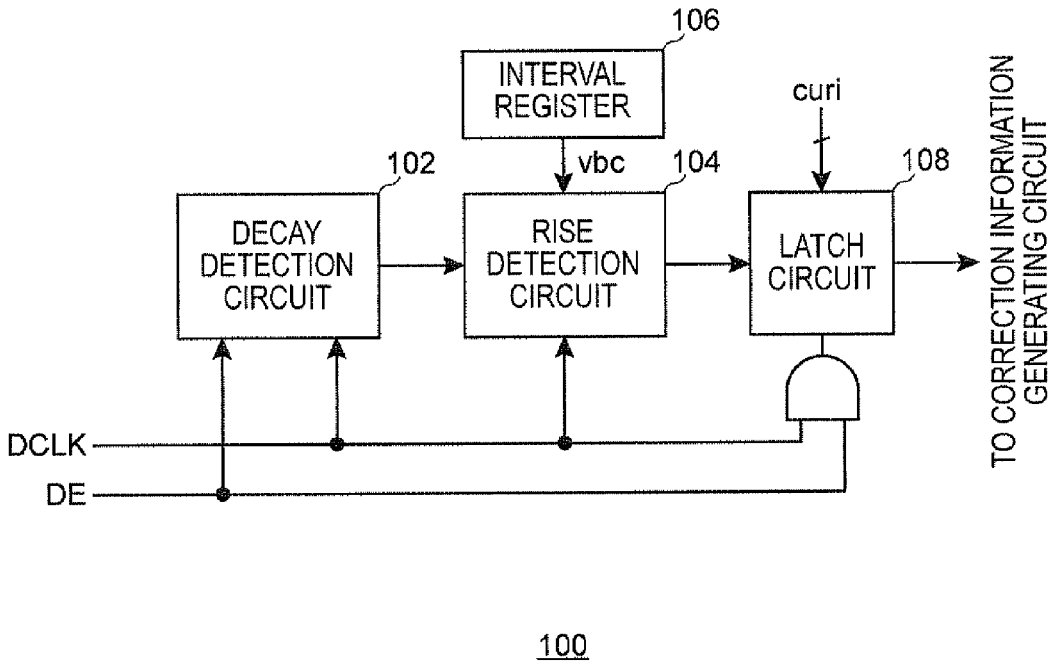
FIG. 5 A block diagram of a configuration example of a current measurement value import circuit of FIG. 4.

FIG. 5 shows a block diagram of a configuration example of the current measurement value import circuit 100 of FIG. 4. In the embodiment, a configuration of the current measurement value import circuit 100 is not limited to the one shown in FIG. 5.

Figure 6:
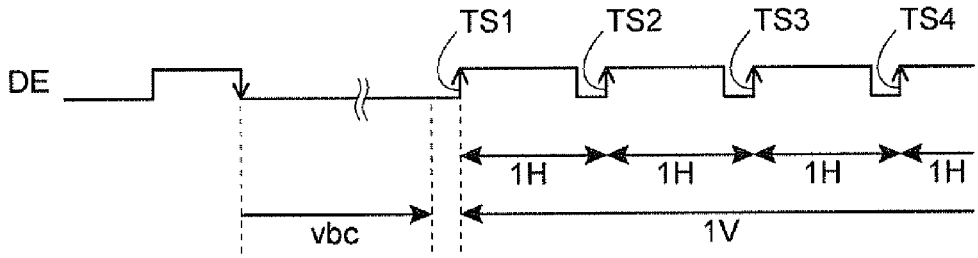
FIG. 6 An illustration of an operation example of the current measurement value import circuit of FIG. 4.

FIG. 6 shows an illustration of an operation example of the current measurement value import circuit 100 of FIG. 4.

The current measurement value import circuit 100 includes a decay detection circuit 102, a rise detection circuit 104, an interval register 106, and a latch circuit 108. The decay detection circuit 102 detects a decay of the data enable signal DE in synchronization with the pixel clock DCLK. Herein, it is taken that the pixel data output in synchronization with the pixel clock DCLK are valid when the data enable signal DE is at an H level, and that the pixel data are invalid when the data enable signal DE is at an L level. A result of this kind of detection by the decay detection circuit 102 is supplied to the rise detection circuit 104.

The control data corresponding to a period specifying a vertical blanking period vbc are set in the interval register 106 by, for example, the host 60, and the control data corresponding to the vertical blanking period vbc are supplied to the rise detection circuit 104.

After the vertical blanking period vbc corresponding to the control data set in the interval register 106 has elapsed after the decay of the data enable signal DE has been detected by the decay detection circuit 102, the rise detection circuit 104 detects a rise of the data enable signal DE in synchronization with the pixel clock DCLK. A result of the detection of the rise detection circuit 104 is supplied to the latch circuit 108.

Apart from the result of the detection of the rise detection circuit 104, the current value curi converted into the digital value by the A/D converter 76 of FIG. 1, the data enable signal DE, and the pixel clock DCLK are input into the latch circuit 108. Then, on the rise of the data enable signal DE being detected by the rise detection circuit 104, the latch circuit 108 imports the current value curi in synchronization with a result of a logical and operation of the data enable signal DE and pixel clock DCLK. The current value curi imported by the latch circuit 108 is supplied to the correction information generating circuit 110 as the operating current value (the information corresponding to the operating current).

By means of this kind of configuration, the current measurement value import circuit 100 can sequentially import the operating current values for driving the light emitting elements of pixels to be measured, by lighting the light emitting elements in order in units of one pixel configuring a scanning line to be measured, in a horizontal scanning period started every time the data enable signal DE rises in a vertical scanning period started after the data enable signal DE has decayed, the immediately preceding vertical scanning period has finished, and the vertical blanking period vbc has elapsed, as shown in FIG. 6.

For example, at a measurement timing TS1 of FIG. 6, operating current values are acquired in units of one pixel configuring a scanning line starting with a pixel position (0, 1), and at a next measurement timing TS2, operating current values are acquired in units of one pixel configuring a scanning line starting with a pixel position (0, 2). In the same way, at a measurement timing TS3, operating current values are acquired in units of one pixel configuring a scanning line starting with a pixel position (0, 3), and at a measurement timing TS4, operating current values are acquired in units of one pixel configuring a scanning line starting with a pixel position (0, 4).

<Correction Information Generating Circuit>

Figure 7:
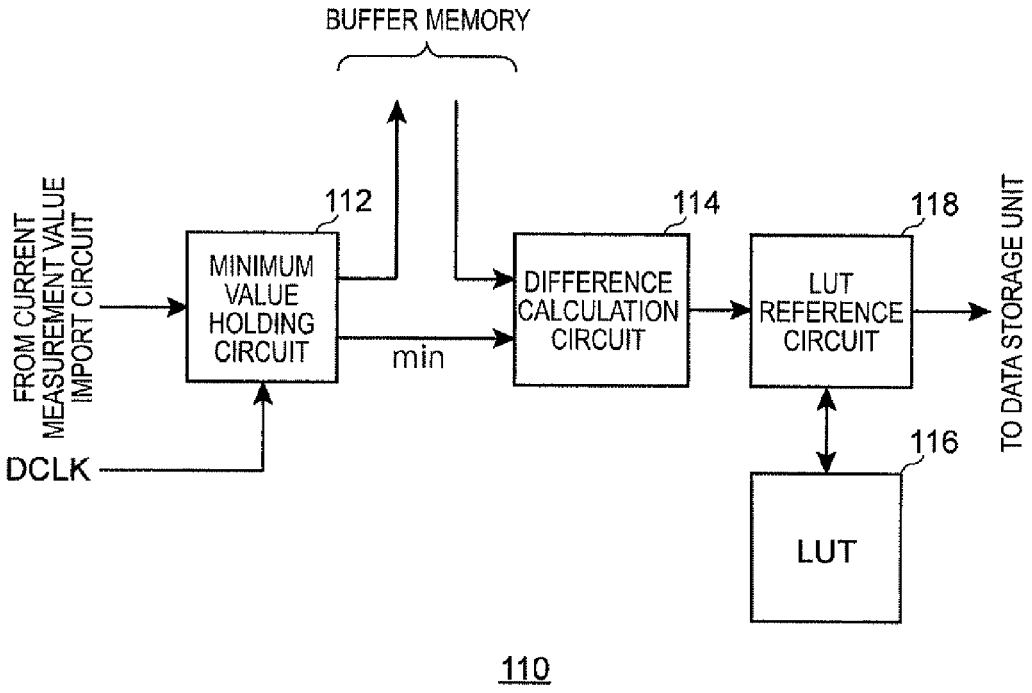
FIG. 7 A block diagram of a configuration example of a correction information generating circuit of FIG. 4.

FIG. 7 shows a block diagram of a configuration example of the correction information generating circuit 110 of FIG. 4. In the embodiment, a configuration of the correction information generating circuit 110 is not limited to the one shown in FIG. 7.

The correction information generating circuit 110 includes a minimum value holding circuit 112, a difference calculation circuit 114, a look up table (hereafter abbreviated as an LUT) 116, and an LUT reference circuit 118. The operating current values of the light emitting elements are sequentially input into the correction information generating circuit 110, in units of one pixel in one screen, in synchronization with the pixel clock DCLK. The minimum value holding circuit 112 detects a minimum operating current value from among a plurality of the operating current values input in units of one pixel in one screen, and holds the minimum operating current value.

Figure 8:
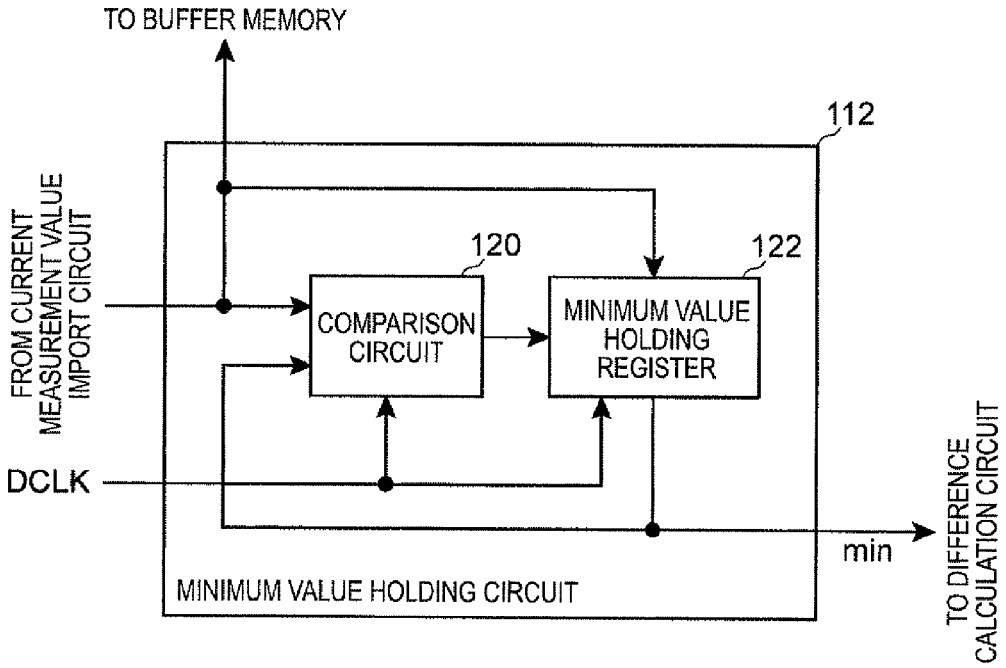
FIG. 8 A block diagram of a configuration example of a minimum value holding circuit of FIG. 7.

FIG. 8 shows a block diagram of a configuration example of the minimum value holding circuit 112 of FIG. 7. In the embodiment, a configuration of the minimum value holding circuit 112 is not limited to the one shown in FIG. 8.

The minimum value holding circuit 112 includes a comparison circuit 120 and a minimum value holding register 122. Storage information of the minimum value holding register 122 is initialized prior to the detection of the operating currents in one screen, and a minimum operating current value, among a plurality of the operating current values input in units of one pixel in one screen, is held in the minimum value holding register 122. The comparison circuit 120, in synchronization with the pixel clock DCLK, compares the operating current values imported by the current measurement value import circuit 100 and the minimum operating current value held by the minimum value holding register 122, and activates a result of the comparison when the input operating current values become lower than the minimum operating current value held by the minimum value holding register 122. The minimum value holding register 122, when the result of the comparison of the comparison circuit 120 is active, holds the operating current values imported by the current measurement value import circuit 100.

By carrying out this kind of operation repeatedly on the plurality of operating current values in one screen, eventually, a minimum operating current value min is held by the minimum value holding register 122. The minimum operating current value min is supplied to the difference calculation circuit 114. Also, the operating current values which, being input into the comparison circuit 120, have been imported by the current measurement value import circuit 100 are sequentially stored in the buffer memory 80.

On the minimum operating current value min being determined from among the operating current values in units of one pixel in one screen, the difference calculation circuit 114 carries out a control of retrieving the operating current values acquired in units of one pixel from the buffer memory 80. Then, the difference calculation circuit 114 subtracts the minimum operating current value min from the operating current values retrieved from the buffer memory 80, and calculates difference values as the difference information.

Output values corresponding to a plurality of input values are stored in a table form in advance in the LUT 116. The LUT reference circuit 118, by giving the input values to the LUT 116 and carrying out an access control, can carry out a heretofore known interpolation process on the output values from the LUT 116 when necessary.

Figure 9:
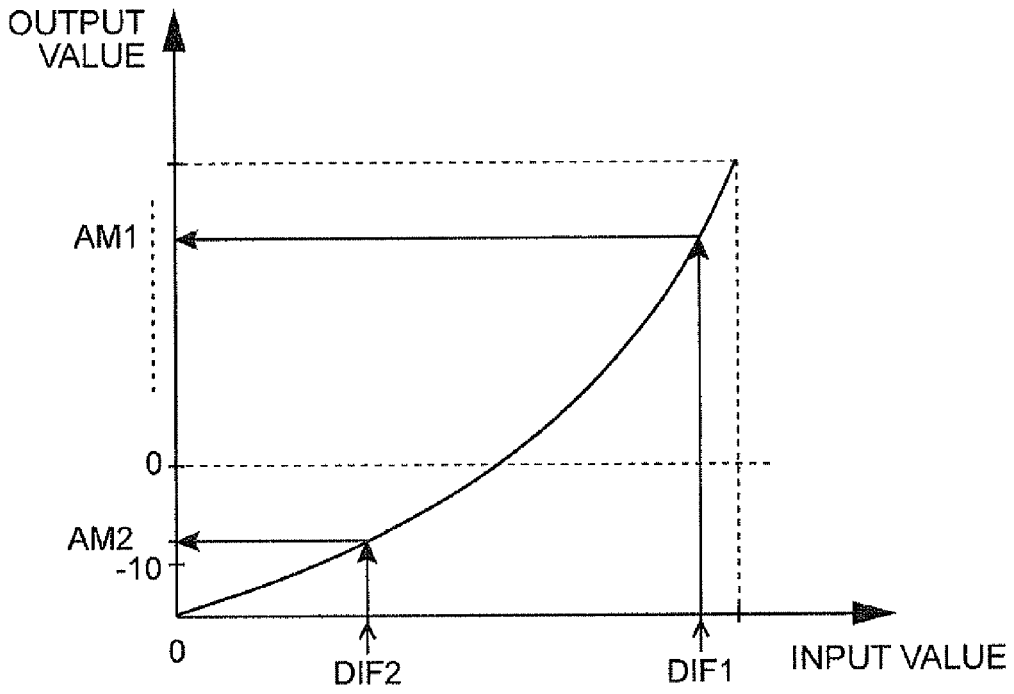
FIG. 9 An operational illustration of an LUT, and LUT reference circuit, of FIG. 7.

FIG. 9 shows an operational illustration of the LUT 116 and LUT reference circuit 118 of FIG. 7.

With the difference values from the difference calculation circuit 114 as input values, pixel data correction values corresponding to the difference values are stored in the LUT 116 as output values. For example, the LUT reference circuit 118 accesses the LUT 116 with a difference value DIF1 as the input value of the LUT 116, and retrieves a correction value AM1, and it accesses the LUT 116 with a difference value DIF2 as the input value, and retrieves a correction value AM2.

An arrangement may be such that output values are stored in the LUT 116 correlated only to sampled input values, and the LUT reference circuit 118, by carrying out the heretofore known interpolation process using output values retrieved correlated to two input values, calculates an output value corresponding to a desired input value. Also, for example, as shown in FIG. 9, an arrangement is such that the LUT 116 can output a negative correction value and, depending on the input value, can acquire the negative correction value as the correction information.

The correction values from the LUT reference circuit 118 are stored in the correction information storage unit 134 of the data storage unit 130 as the correction information.

<Pixel Data Analysis Circuit>

As heretofore described, in the embodiment, in the pixel data correction process using the correction information, the enable control is carried out by the pixel data analysis circuit 140.

Figure 10:
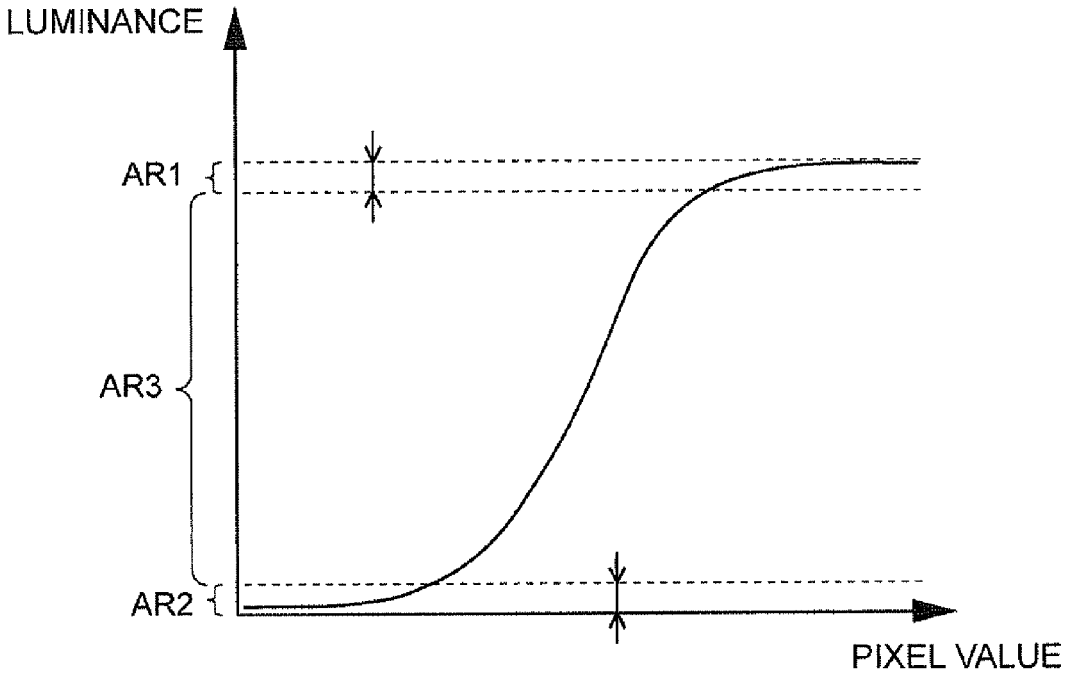
FIG. 10 An operational illustration of a pixel data analysis circuit of FIG. 4.

FIG. 10 shows an operational illustration of the pixel data analysis circuit 140 of FIG. 4. FIG. 10 schematically shows one example of the gamma characteristic of the display panel 20 of FIG. 1. FIG. 10 shows a pixel value corresponding to a gradation value on the horizontal axis, and a luminance on the vertical axis, with regard to the R component, but the same applies to the G component and B component too.

Figure 11:
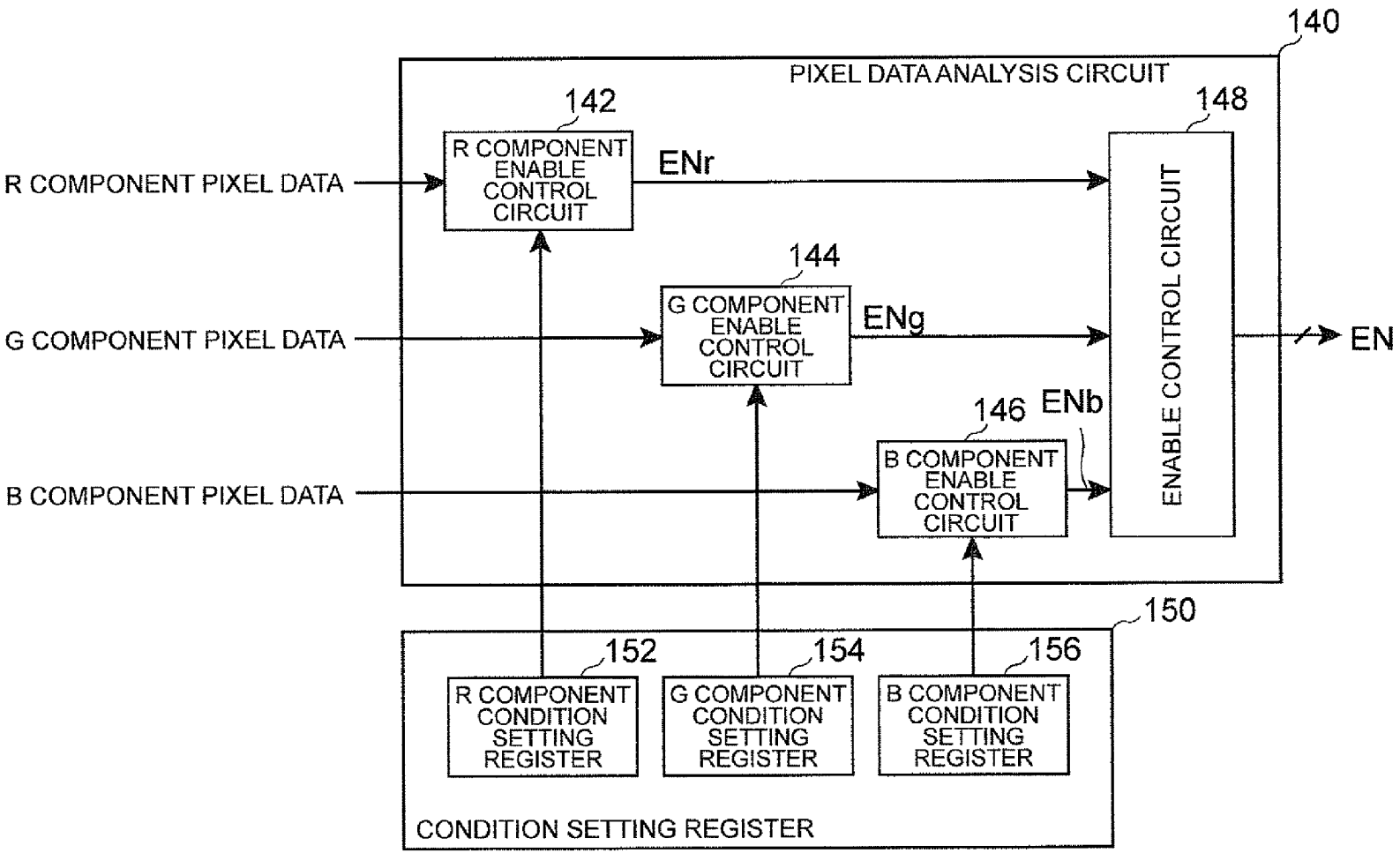
FIG. 11 A block diagram of a configuration example of the pixel data analysis circuit of FIG. 4.

FIG. 11 shows a block diagram of a configuration example of the pixel data analysis circuit 140 of FIG. 4. In FIG. 11, the condition setting register 150 of FIG. 4 is also illustrated in addition. A configuration of the pixel data analysis circuit 140 is not limited to the one shown in FIG. 11.

The display panel 20 of FIG. 1 has the kind of gamma characteristic shown in, for example, FIG. 10. That is, even in the event that the pixel value corresponding to the gradation value is changed at a constant rate, the luminance does not change constantly. For this reason, there exists a portion in which the luminance makes a big change, and a portion in which the luminance makes a small change, in response to a minor change in the pixel value. Moreover, this kind of gamma characteristic varies depending on the color component. Consequently, even in the event that the pixel data are uniformly corrected using the correction information, there is a possibility that an effect hoped for cannot be obtained in some cases.

Therein, in the embodiment, an arrangement is such that, by enabling the condition setting register 150 to set the control data corresponding to the pixel data correction range, the enable control of the correction process of the pixel data correction circuit is carried out based on the control data.

For example, in FIG. 10, the correction process is disabled in regions AR1 and AR2 in which the luminance makes a small change in response to the change in the pixel value, and the correction process is enabled in a remaining region AR3. This kind of way to enable control (disable control) the pixel data correction process is made different from one color component to another.

As an arrangement is such that the enable control of the pixel data correction process for each color component is carried out in this way, it is possible to realize, for example, the color filtering process wherein the pixel data correction is carried out on a gradation portion of skin color or the like in an image because color unevenness becomes conspicuous in the gradation portion depending on the way to enable control, while brightness is secured, without correcting the pixel data, for an image with many white portions such as clouds.

This kind of pixel data analysis circuit 140 includes an R component enable control circuit 142, a G component enable control circuit 144, a B component enable control circuit 146, and an enable control circuit 148, as shown in FIG. 11. Also, the condition setting register 150 shown in FIG. 4 or 11, including an R component condition setting register 152, a G component condition setting register 154, and a B component condition setting register 156, is configured so that the control data corresponding to the correction range can be set correlated to the pixel data of each color component. For example, control data specifying "R component pixel value 200" are set in the R component condition setting register 152, control data specifying "G component pixel value ≥100" are set in the G component condition setting register 154, and control data specifying "B component pixel value ≥50" are set in the B component condition setting register 156. These items of control data of each color component are input into the corresponding color component enable control circuits.

The R component enable control circuit 142, based on the control data set in the R component condition setting register 152, determines whether or not R component pixel data are in the correction range and, based on a result of the determination, generates an enable signal ENr for an R component pixel data correction process. The G component enable control circuit 144, based on the control data set in the G component condition setting register 154, determines whether or not G component pixel data are in the correction range and, based on a result of the determination, generates an enable signal ENg for a G component pixel data correction process. The B component enable control circuit 146, based on the control data set in the B component condition setting register 156, determines whether or not B component pixel data are in the correction range and, based on a result of the determination, generates an enable signal ENb for a B component pixel data correction process.

The enable signals ENr, ENg, and ENb are input into the enable control circuit 148. The enable control circuit 148 generates an enable signal EN in such a way as to satisfy all conditions set in the R component condition setting register 152, G component condition setting register 154, and B component condition setting register 156, and outputs the enable signal EN to the pixel data correction circuit 160. As a result of this, the pixel data correction circuit 160 carries out the correction process on only the pixel data of, for example, dots satisfying "R component pixel value ≥200", "G component pixel value ≥100", and "B component pixel value ≥50".

In FIG. 11, an example has been described as one in which the enable control signal EN is generated in such a way as to satisfy all the condition setting registers of each color component, but the embodiment is not limited to this. An arrangement may be such that the enable control signal EN is generated in such a way as to satisfy only one portion of the conditions set in the condition setting register of each color component.

<Pixel Data Correction Circuit>

Figures 12, 13:
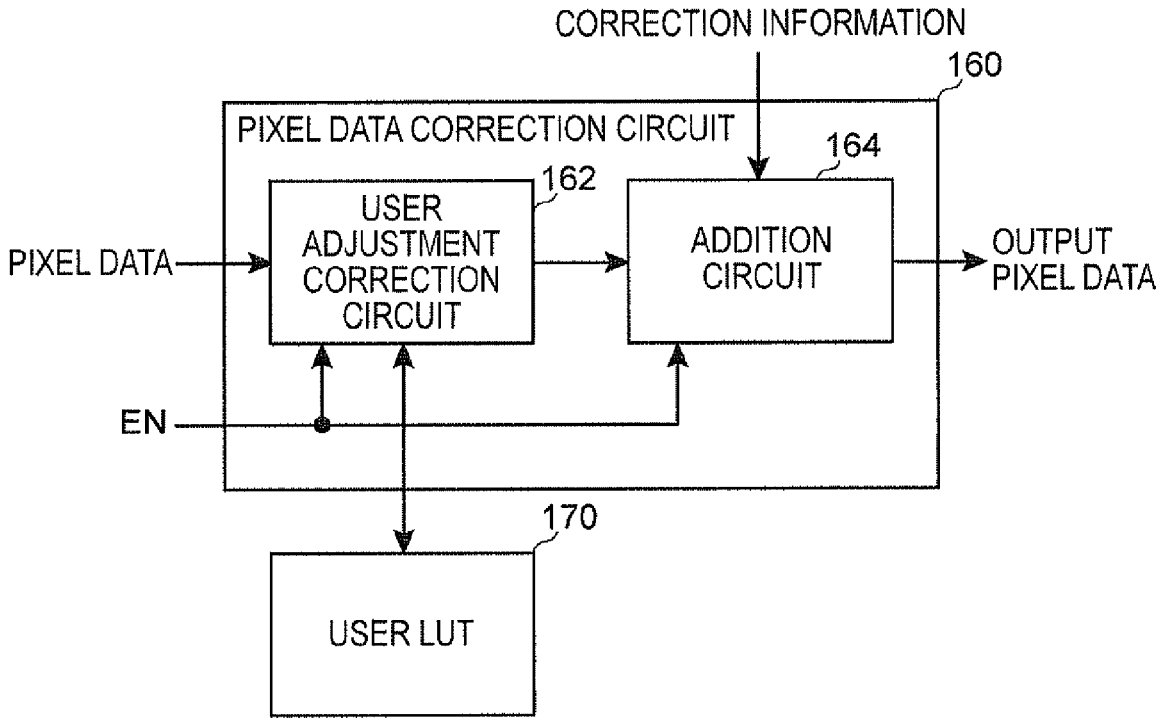
FIG. 12 A block diagram of a configuration example of a pixel data correction circuit of FIG. 4.
FIG. 13 An illustration of a user LUT of FIG. 4 or 12.

FIG. 12 shows a block diagram of a configuration example of the pixel data correction circuit 160 of FIG. 4. In FIG. 12, the user LUT 170 of FIG. 4 is also illustrated in addition. A configuration of the pixel data correction circuit 160 is not limited to the one shown in FIG. 12.

FIG. 13 shows an illustration of the user LUT 170 of FIG. 4 or 12.

The pixel data correction circuit 160 includes a user adjustment correction circuit 162 and an addition circuit 164. The enable control signal EN from the pixel data analysis circuit 140 and the pixel data from the pixel data storage unit 132 are input into the user adjustment correction circuit 162. When the correction process is enable controlled by the enable control signal EN, the user adjustment correction circuit 162 accesses the user LUT 170 using the pixel data from the pixel data storage unit 132. The user LUT 170 has set therein the input value and the output value corresponding to the input value for each color component, as shown in FIG. 13, and the user adjustment correction circuit 162, with the input pixel data as the input value for each color component, acquires the output value stored correlated to the pixel data from the user LUT 170, and outputs the output value to the addition circuit 164 as the adjusted pixel data.

Meanwhile, when the correction process is disable controlled by the enable control signal EN, the user adjustment correction circuit 162 outputs the pixel data from the pixel data storage unit 132, as they are, to the addition circuit 164.

An arrangement may be such that the output values correlated only to the sampled input values are stored in the user LUT 170, and the user adjustment correction circuit 162, by carrying out the heretofore known interpolation process using output values retrieved correlated to two input values, calculates an output value corresponding to a desired input value.

The correction information from the correction information storage unit 134, the enable control signal EN from the pixel data analysis circuit 140, and the adjusted pixel data from the user adjusted correction circuit 162 are input into the addition circuit 164. When the correction process is enable controlled by the enable control signal EN, the addition circuit 164 carries out an addition process for each color component on the pixel data from the user adjustment correction circuit 162 and the correction information, and outputs the pixel data after the addition process as output pixel data. In the embodiment, as a negative correction value is also permitted as the correction information, the pixel data correction process using the correction information can be realized by a simple addition process.

Meanwhile, when the correction process is disable controlled by the enable control signal EN, the addition circuit 164 outputs the pixel data from the user adjustment correction circuit 162, as they are, as the output pixel data.

The output pixel data output by this kind of pixel data correction circuit 160 are supplied to the column driver 40 together with the column signals.

As heretofore described, according to the embodiment, as an arrangement is such that the information corresponding to the operating currents of the light emitting elements is stored in units of the one or plurality of pixels of the display panel, and the pixel data are corrected based on the information, it is possible to simultaneously correct the variations in the light emitting elements and in the drive current which drives the light emitting elements, and reduce the luminance and color unevenness with a high precision.

The display system 10 according to the embodiment can be applied to, for example, the following kinds of electronic apparatus.

Figure 14A:
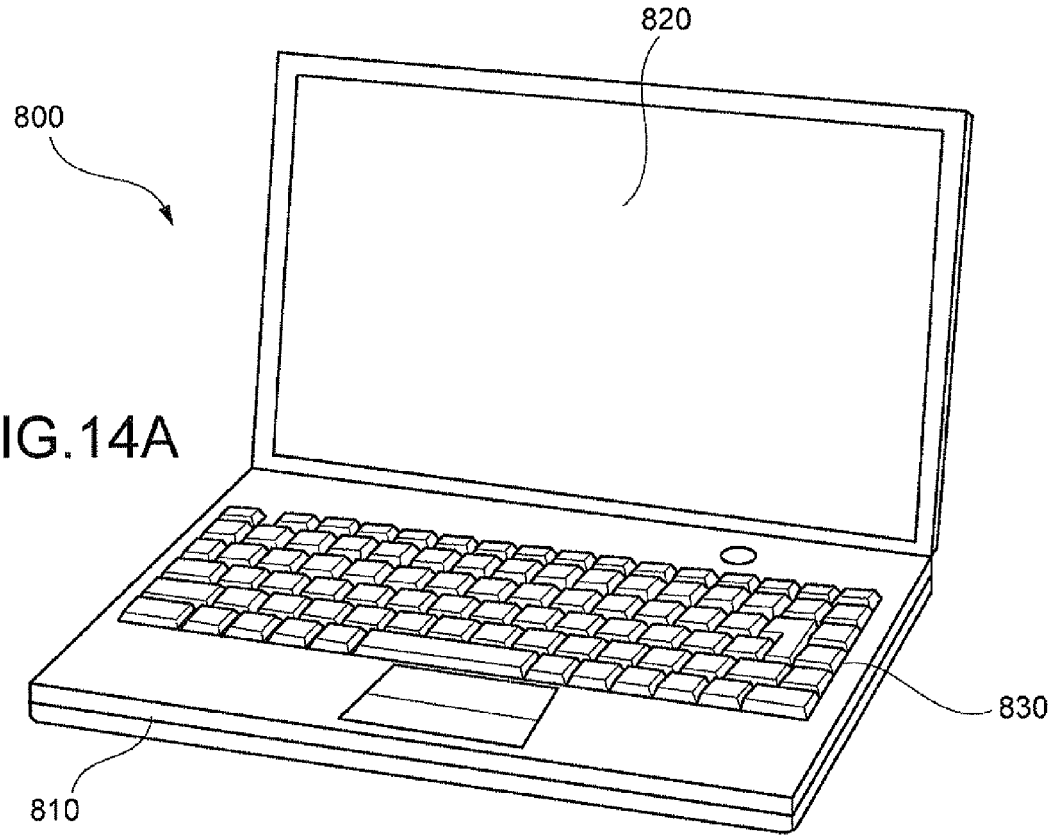
FIG. 14 Perspective views showing configurations of electronic apparatus to which is applied the display system according to the embodiment.
Figure 14B:
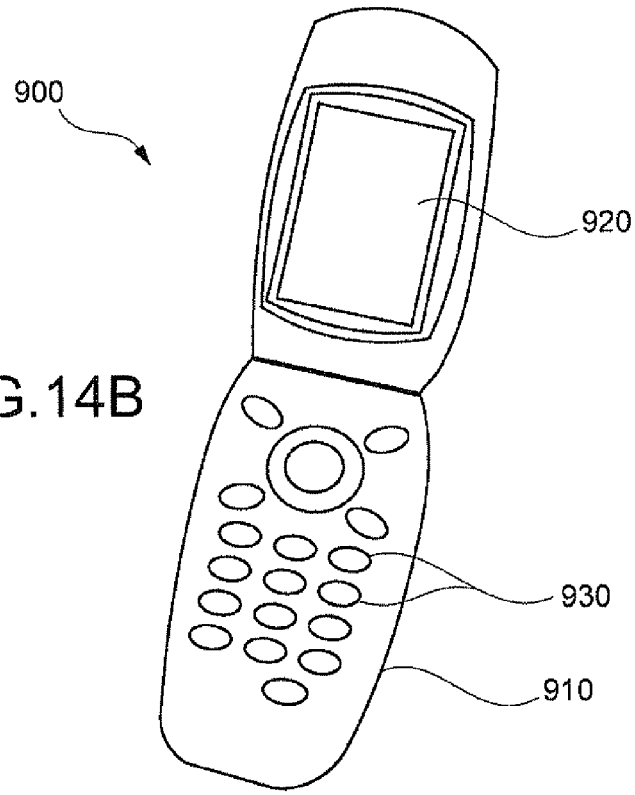

FIGS. 14(A) and 14(B) show perspective views showing configurations of electronic apparatus to which is applied the display system 10 according to the embodiment. FIG. 14(A) represents a perspective view of a configuration of a mobile type personal computer. FIG. 14(B) represents a perspective view of a configuration of a mobile telephone.

The personal computer 800 shown in FIG. 14(A) includes a main body portion 810 and a display portion 820. The display system 10 according to the embodiment is mounted as the display portion 820. The main body portion 810 includes the host 60 of the display system 10, and a keyboard 830 is provided in the main body portion 810. That is, the personal computer 800 is configured including at least the timing controller 50 according to the heretofore described embodiment. Operation information going through the keyboard 830 is analyzed by the host 60, and an image is displayed on the display portion 820 in accordance with the operation information. As the display portion 820 has OLED's as its display elements, it is possible to provide a personal computer 800 having a screen with a wide viewing angle.

The mobile telephone 900 shown in FIG. 14B includes a main body portion 910 and a display portion 920. The display system 10 according to the embodiment is mounted as the display portion 920. The main body portion 910 includes the host 60 of the display system 10, and a keyboard 930 is provided in the main body portion 910. That is, the mobile telephone 900 is configured including at least the timing controller 50 according to the heretofore described embodiment. Operation information going through the keyboard 930 is analyzed by the host 60, and an image is displayed on the display portion 920 in accordance with the operation information. As the display portion 920 has OLED's as its display elements, it is possible to provide a mobile telephone 900 having a screen with a wide viewing angle.

Electronic apparatus to which is applied the display system 10 according to the embodiment, not being limited to the ones shown in FIGS. 14(A) and 14(B), includes a PDA (personal digital assistants), a digital still camera, a television, a video camera, a car navigation system, a pager, an electronic notebook, electronic paper, an electronic calculator, a word processor, a workstation, a television telephone, a POS (point of sale system) terminal, a printer, a scanner, a copier, a video player, an apparatus including a touch panel, and the like.

As heretofore described, a description has been given, based on the heretofore described embodiment, of the image processing apparatus, display system, electronic apparatus, image processing method, and the like, according to the invention, but the invention, not being limited to the heretofore described embodiment, can be implemented in various forms without departing from the scope thereof, and, for example, the following kinds of modification are also possible.

(1) In the embodiment, the display system to which are applied the OLED's having the configuration shown in FIGS. 1 to 3 has been described as an example, but the invention is not limited to this.

(2) In the embodiment, the operating current values have been described as being acquired in units of one pixel, but the invention is not limited to this. For example, an arrangement may be such that the operating current values are measured on the power wire from the power circuit 70 in units of a plurality of pixels, and the luminance and color unevenness of the OLED's are corrected by correcting the pixel data based on the operating current values.

(3) In the embodiment, the timing controller 50 has been described as including the current measurement value import circuit 100, but the invention is not limited to this. For example, the current measurement value import circuit 100 may be provided outside the timing controller 50.

(4) In the embodiment, the invention is not limited by the type of the column signals generated by the column signal generating circuit 180.

(5) In the embodiment, the invention is not limited by the type of the row signals generated by the row signal generating circuit 190.

(6) In the embodiment, the pixel data storage unit 132 and correction information storage unit 134 are provided as the data storage unit 130, but the invention is not limited to this.

(7) In the embodiment, the invention has been described as the image processing apparatus, display system, electronic apparatus, image processing method, and the like, but the invention is not limited to this. For example, the invention may also be, for example, a program in which is described a processing procedure of the heretofore described image processing method, or a recording medium on which the program is recorded.

What is claimed is:

1. An image processing apparatus which corrects pixel data corresponding to pixels configuring a display image of a display device having light emitting elements, comprising:

an information storage unit which, in units of one or a plurality of pixels of the display device, stores information corresponding to operating currents of light emitting elements included in the one or plurality of pixels;

a pixel data correction unit which corrects the pixel data based on the information corresponding to the operating currents stored in the information storage unit, wherein a correction information is generated while the information corresponding to the operating current is stored in the information storage unit;

a correction information generating unit which generates correction information corresponding to the operating currents of the light emitting elements included in the one or plurality of pixels, wherein the information storage unit stores the correction information, and the correction information generating unit generates the correction information based on difference information having a minimum operating current of the operating currents of the light emitting elements included in the one or plurality of pixels as a reference in one screen;

a condition setting register in which control data corresponding to a pixel data correction range are set; and a pixel data analysis unit which, based on the control data set in the condition setting register, carries out a process of determining whether or not to correct the pixel data, wherein the pixel data correction unit is such that an enable control of a process of correcting the pixel data is carried out based on a result of the processing of the pixel data analysis unit, the condition setting register including an R component condition setting register, a G component condition setting register and a B component condition setting register, the enable control including R component enable control, G component enable control and B component enable control, the R component enable control is based on the control data set in the R component condition setting register, the G component enable control is based on the control data set in the G component condition setting register, and the B component enable control is based on the control data set in the B component condition setting register.

2. The image processing apparatus according to claim 1, wherein the control data specifying that each component pixel value of R, G and B is equal to or larger than each of a pixel value corresponding to a set gradation value.

* * * * *